US008127550B2

(12) United States Patent
Harris, Jr. et al.

(10) Patent No.: US 8,127,550 B2
(45) Date of Patent: Mar. 6, 2012

(54) ANTI-FLASHBACK FEATURES IN GAS TURBINE ENGINE COMBUSTORS

(75) Inventors: Arthur J. Harris, Jr., Orlando, FL (US); Rajeev Ohri, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 858 days.

(21) Appl. No.: 11/656,723

(22) Filed: Jan. 23, 2007

(65) Prior Publication Data

US 2010/0269509 A1 Oct. 28, 2010

(51) Int. Cl.
*F02C 1/00* (2006.01)

(52) U.S. Cl. ..... 60/748; 60/752

(58) Field of Classification Search ..... 60/39.11, 60/722, 737, 740, 748, 752
See application file for complete search history.

(56) References Cited

U.S. PATENT DOCUMENTS

| | | | | |
|---|---|---|---|---|
| 5,076,062 | A | 12/1991 | Abreu | |
| 5,813,232 | A | 9/1998 | Razdan et al. | |
| 6,082,111 | A * | 7/2000 | Stokes | 60/737 |
| 6,179,608 | B1 | 1/2001 | Kraemer et al. | |
| 6,705,087 | B1 * | 3/2004 | Ohri et al. | 60/748 |
| 7,370,466 | B2 * | 5/2008 | Cai | 60/39.11 |

FOREIGN PATENT DOCUMENTS

| | | | |
|---|---|---|---|
| DE | 19859829 | A1 | 6/2000 |
| EP | 0935097 | A2 | 8/1999 |
| EP | 1134494 | A1 | 9/2001 |
| EP | 1400754 | A1 | 3/2004 |
| WO | 9840670 | A1 | 9/1998 |
| WO | 2006027989 | A1 | 3/2006 |

* cited by examiner

*Primary Examiner* — Louis Casaregola

(57) ABSTRACT

A gas turbine combustor (10) comprises a base plate (12) from which protrude a plurality of lips (36) that surround respective apertures (16) into which are positioned downstream ends (19) of main swirler assemblies (18). The apertures (16) are arranged about a centrally positioned pilot cone (22) that comprises an inner cone (23) and an outer cone (25), defining a space (31) there between. A number of laterally directed apertures (60) are disposed along the outer cone (25) so as to direct a flow of fluid toward a near portion (38) of each lip (36), thereby perturbing pockets of high fuel-to-air mixtures between the outer cone (25) and the near region (38). The provision of such laterally directed apertures (60) reduces or eliminates flashback between the outer cone (25) and the near region (38) through such action.

6 Claims, 3 Drawing Sheets

ANTI-FLASHBACK FEATURES IN GAS TURBINE ENGINE COMBUSTORS

FIELD OF THE INVENTION

This invention relates to a combustion products generator, such as a gas turbine, having a combustor comprising fuel/air mixing apparatuses in operational orientation with a base plate that separates such apparatuses from a combustion zone. Features, such as in a centrally disposed pilot cone, that provide focussed lateral fluid discharge across the base plate are effective to reduce the occurrence of undesired flashbacks.

BACKGROUND OF THE INVENTION

Gas turbine engines are combustion-based machines that convert chemical energy stored in fuel into mechanical energy useful for generating electricity, producing thrust, or otherwise doing work. These engines typically include several cooperative sections that contribute in some way to this energy conversion process. Air discharged from a compressor section and fuel introduced from a fuel supply are mixed together and burned in a combustion section. The products of combustion are harnessed and directed through a turbine section, where they expand and turn a central rotor, thereby converting into the mechanical energy.

In that combustion is a critical aspect of the operation of a gas turbine engine, various efforts are made to control the combustion to a desired level and location. A variety of combustor designs exist, each having a specified combustion zone as an area for combustion to occur. Aspects of combustion that must be balanced in modern gas turbine engines are the potential for flashbacks, operational efficiency and ease of operation, and emissions from the combustion process.

Flashback is undesired and potentially damaging combustion that occurs when a flame travels upstream from a combustion zone and approaches, contacts, and/or attaches to, an upstream component. Although a stable but lean mixture is desired for fuel efficiency and for environmentally acceptable emissions, a flashback may occur at times more frequently with a lean mixture, and particularly during unstable operation that may occur during lean operations. For instance, the flame in the combustion chamber may progress backwards and rest upon, for a period, a base plate that is disposed perpendicularly to the flow-axis and defines a partial flow barrier. Less frequently, the flame may flash back into a fuel/air mixing apparatus, positioned upstream of the base plate, damaging components that mix the fuel with the air. In addition to damaging combustion system components, flashback often results in unloading or shutdown of the engine.

Gas turbine technology is evolving toward greater efficiency, in part to accommodate environmental standards in various nations, and in various approaches this results in the use of leaner gas air mixtures for the main fuel/air mixing apparatuses. This approach provides for increased efficiency and decreased emissions of NOx and carbon monoxide. However, a richer fuel/air mixture often is used in a centrally disposed pilot flame that is provided to maintain combustion. Notwithstanding the overall low emissions objective, combustion of over-rich pockets of fuel and air, such as from the pilot flame, leads to high-temperature combustion that produces high levels of unwanted NOx emissions. In view of the low NOx objective, gas turbine engine systems are designed to minimize such over-rich pockets.

However, as noted lean operating conditions may lead to a greater risk of flashbacks due to flame instability and operational fluctuations. Various approaches to reduce or eliminate flashback in modern gas turbine combustion systems have been attempted. Since the prevention or elimination of flashbacks is a multi-factorial issue and also relates to various aspects of the design and operation of the gas turbine combustion area, a range of approaches has been attempted. These approaches often inter-relate with, and at times supplement one another.

The inventors of the present invention have appreciated the importance of improving flow patterns near the base plate as a valuable approach to reduction of specific flashback damage. They have appreciated a need to improve such flow patterns, and have sought to effectuate appropriate solutions to address this need.

BRIEF DESCRIPTION OF THE DRAWINGS

The foregoing and other features of the invention will be apparent from the following more particular description of the invention, as illustrated in the accompanying drawings.

DETAILED DESCRIPTION OF THE INVENTION

Figure 1A:
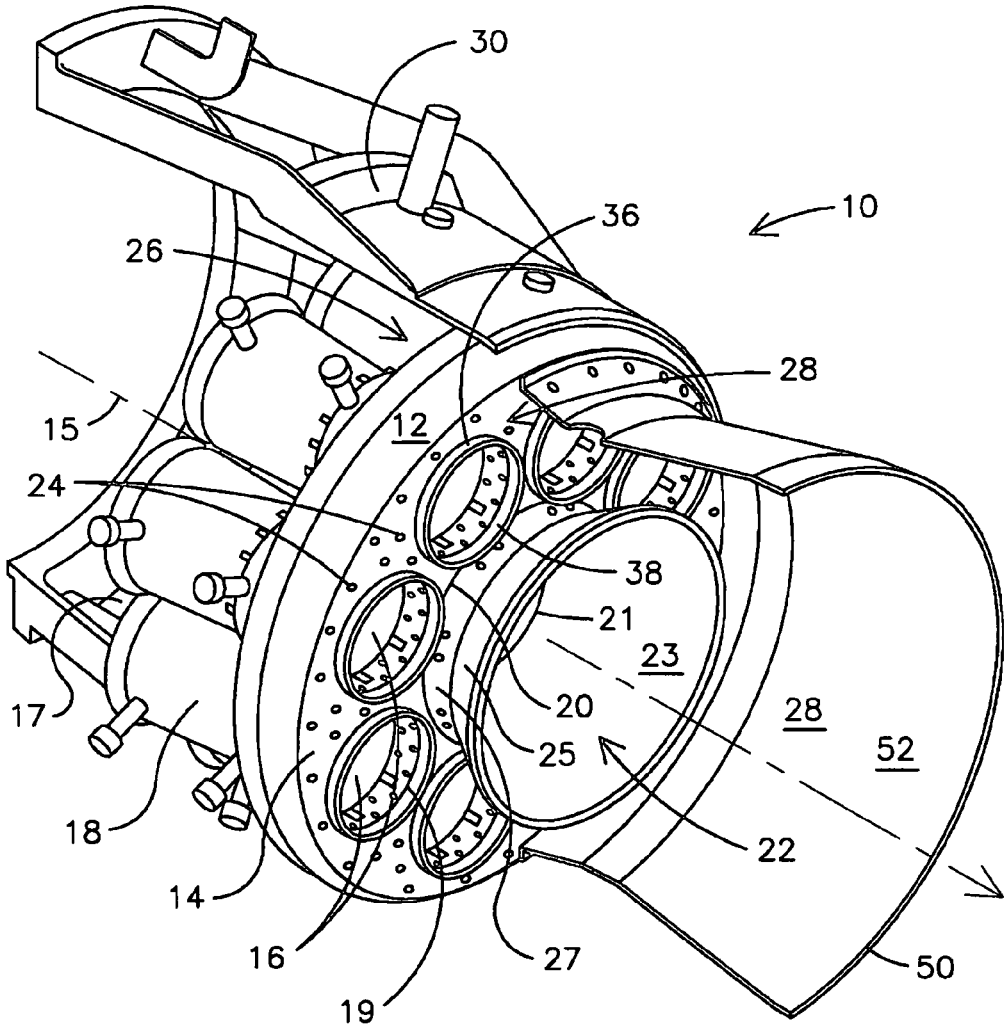
FIG. 1A is a partial cut-away perspective view of a combustor that depicts one embodiment of the present invention.

Embodiments of the present invention comprise features that provide a focused lateral fluid discharge across a base plate, this discharge being effective to reduce or eliminate the occurrence of undesired flashbacks on or near the base plate. In various embodiments this is achieved by the placement of apertures centrally disposed, for example along a centrally positioned pilot cone, where these apertures direct cooling fluid laterally outward toward specific areas of interest. For combustors of various gas turbine engines a base plate separates the main, peripheral fuel/air mixing apparatuses (e.g., main swirler assemblies) from a more downstream combustion zone, with a pilot burner and its surrounding pilot cone extending from a central aperture of the base plate. In some embodiments an extruded lip on the base plate surrounds a respective downstream end of each main swirler assembly, and appropriate cooling fluid flow patterns near this lip are desired. To achieve this, a plurality of apertures, such as in a cone surrounding the pilot burner, are provided for passage of cooling fluid. Lateral discharge of cooling fluid, such as compressed air, is provided by such apertures that are centrally located relative to the lips and that are spaced to provide a specific pattern of such fluid. This pattern effectively perturbs areas where high fuel-to-air concentrations may otherwise reside and cause a flashback. This perturbation reduces or eliminates flashback on nearby areas of the extruded lips of the base plate that surround the respective main swirler assemblies.

Further to combustor elements used in the examples provided below, among the variety of combustor designs is a design known as a can-annular type design. In such design a plurality of arranged can-shaped combustors are distributed on a circle perpendicular to a flow-axis of the gas turbine engine. Within each such can-shaped combustor is a centralized pilot burner (hereinafter referred to as a pilot burner or simply pilot) and a number of main fuel/air mixing apparatuses, often referred to as "main swirler assemblies." The main fuel/air mixing apparatuses are arranged circumferentially around the pilot burner. With this design, a central pilot flame zone and a mixing region are formed. During operation, the pilot burner selectively produces a stable flame in the pilot flame zone, while the fuel/air mixing apparatuses each produce a mixed stream of fuel and air in the above-referenced mixing region. The stream of mixed fuel and air flows out of the mixing region, past the pilot flame zone, and into a main combustion zone, where the majority of combustion occurs. As noted above, energy released during combustion is captured by the downstream components to produce electricity or otherwise do work.

For example, during operation of a can-annular type combustor, in each "can" a central pilot provides a constant flame, albeit often of a richer fuel/air mixture to assure continuity of the flame during varying operations. Each of a plurality of axially positioned main swirler assemblies emits a fuel/air mixture that enters the combustion chamber and becomes ignited. As the fuel/air ratio of the fuel/air mixture from these main swirler assemblies is made leaner, which is done for efficiency and/or to meet environmental standards for emissions, the combustion system tends to become less stable. Under such conditions, and based on a number of variables including combustion dynamics that typically are in flux, a flashback of the flame to the base plate may occur. Over time, repeated occurrence of flashbacks to the base plate, or less frequently to components within the main swirler assembly inner body, may damage the base plate, main swirlers, combustor liner and other components as these are not designed for repeated direct exposure to flame temperature.

Figure 1B:
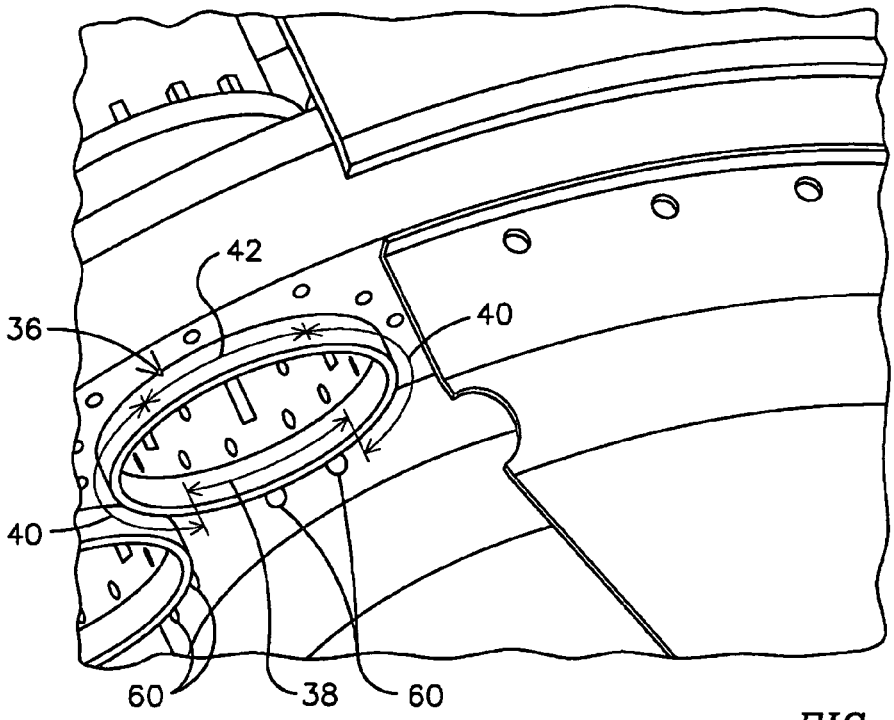
FIG. 1B is an enlarged view of one portion of the combustor of FIG. 1A.
Figure 1C:
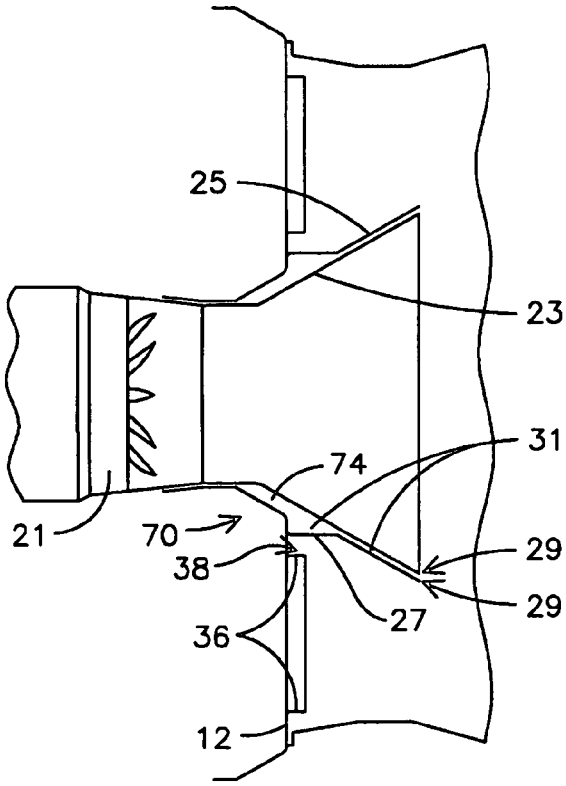
FIG. 1C is a schematic partial cross-section view taken along the line C-C of FIG. 1A.

FIGS. 1A-C provide an example of one embodiment of the present invention that may be used in can-annular combustors. FIG. 1A provides a partial cut-away perspective view of a combustor 10. The combustor 10 comprises a base plate 12 having a body 14 extending perpendicularly to a longitudinal flow-axis 15 of the combustor 10 to define a partial flow barrier. The base plate 12 comprises at least one aperture 16 (referred to by some in the field as an "extruded hole") for a main swirler assembly 18, a centrally disposed aperture 20 for a pilot burner 21 (not directly viewable in FIG. 1A, see FIG. 1C) which is surrounded by a pilot cone 22, and a plurality of axially-directed apertures 24 for passage of fluid from an upstream side 26 to a downstream side 28 of the base plate 12. Each main swirler assembly 18 comprises an upstream end 17 and a downstream end 19, the downstream end 19 disposed in one of the at least one apertures 16. Details of certain of these and other relationships among components, described below, may also be viewed in the partial enlargement view, FIG. 1B.

Within a combustor basket 30, which is a component of combustor 10, are positioned the main swirler assemblies 18 that have downstream ends 19 surrounded by optional lips 36 of base plate 12. Each lip 36 extends to the downstream side 28 from the base plate body 14, as clearly viewable in FIG. 1C, which is a partial cross-section view taken along the line C-C of FIG. 1A. Also, as best viewable in FIG. 1B, each lip 36 has a near portion 38 disposed closest to the centrally disposed aperture 20, side portions 40 disposed laterally and farther from the centrally disposed aperture 20 relative to the near portion 38, and far portions 42 disposed radially outward from the side portions 40.

The present inventors have appreciated that flashbacks are more likely to occur along the near portion 38, and believe (without being bound to a particular theory) that this is due to the tendency of pockets of high fuel/air ratio fuel/air mixtures to be present in these regions. This tendency is believed due to formation of recirculation zones that may entrain high fuel-to-air mixtures that are prone to flashback. The source of such hypothesized high fuel-to-air mixtures is believed to be the centrally disposed pilot burner 21 which is designed to operate with a richer fuel-to-air mixture to maintain flame stability.

The solution described herein adds a flow of fluid, such as air, to lean out the fuel-to-air mixture in an area that includes the near portion 38. More particularly with regard to the embodiment of FIGS. 1A-C, downstream of the pilot burner 21 is the pilot cone 22, which comprises an inner cone 23 and an outer cone 25, and extends from a base section 27 outwardly and downstream to partially form a pilot flame area 28. (Also, a combustor shroud 50 partially defines a combustion zone 52.) Pairs of laterally directed apertures 60 through the outer cone 25 direct a flow of fluid (e.g., compressed air, not shown) laterally toward each lip 36 in the region of the respective lip 36 that is closest to the pilot cone 22, e.g., toward the near portion 38. These laterally directed apertures 60 are observable more distinctly in FIG. 1B, and enlarged view of a portion of FIG. 1A. By lateral flow and laterally directed apertures such as 60 in these figures, it is appreciated that these provide an axial discharge of fluid, such as air, relative to a flow-axis of the major fluid flow of the gas turbine engine, that is, axially relative to the longitudinal flow-axis 15 of the combustor 10. The laterally directed apertures 60 solve the problem of accumulating pockets of high fuel-to-air mixtures, and appropriately lean these out to reduce or eliminate flashbacks in the area that include the near portion 38.

Further to the supply of fluid for such laterally direct apertures 60, a space 31 between the inner cone 23 and the outer cone 25 is in fluid communication with a source of compressed air upstream of the base plate 12. This is depicted in FIG. 1C, the partial cross-section view taken along the line C-C of FIG. 1A. For example, apertures of any sort may be provided through the region of base plate 12 indicated by 70 to allow a fluid such as compressed air to pass from upstream region 72 into space 74 between inner cone 23 and outer cone 25. Base section 27, which is contiguous with outer cone 25 and is securely affixed to an adjacent portion of base plate 12, is in fluid communication with space 74, and comprises laterally directed apertures 60 (see FIGS. 1A and 1B) through which the fluid, such as compressed air, flows as described herein. Fluid that does not pass through the laterally directed apertures 60 passes between inner cone 23 and outer cone 25 to their respective distal ends, and then into the combustion zone 52 (see FIG. 1A).

Thus, the laterally directed apertures 60 viewable in FIGS. 1A and 1B receive fluid from an established source that more generally is used to maintain a desired level of cooling of the pilot cone 22. The use of a portion of this air flow to selectively perturb areas of potential high fuel/air ratio lateral to the upstream base end of the pilot cone 22, near the lips 36, advantageously reduces or eliminates flashback in such region at relatively low cost of implementation and operation. This elegant solution contrasts with other approaches that may be more complex and costly.

In the embodiment depicted in FIGS. 1A and 1B each pair of laterally directed apertures 60 is along a circumference positioned closest to a particular lip 36. The flow of the apertures 60 is directed straight, axially outwards, to that closest part of the lip 36. In this embodiment the fluid from the apertures 60 more directly strikes this more inward, closest part of the lip 36, i.e., the near portion 38. In such embodiment the apertures are unevenly spaced around the circumference of the pilot cone base section 27, and are consistently positioned axially inward to each such inward part of the lip 36.

This is not meant to be limiting, and in other embodiments various laterally directed apertures may be positioned (uniformly or non-uniformly) and angled, such as by angled drilling, welding on of angled jets, and the like, known to those skilled in the art, to provide a desired pattern of angled cross flow across the regions generally between the base section 27 of cone 22 and the lips 36. By itself or in combination with angling of the laterally directed apertures, such apertures may be spaced in any of a number of patterns with selected spacing, aperture sizing, and positioning. Thus, any of a range of aperture patterns may be employed for the laterally directed apertures in various embodiments. Also, it is appreciated that the outer cone 25 is merely one of any number of structures that may be provided adjacent the pilot burner aperture, and that any such structure may comprise a plurality of laterally-directed apertures effective to reduce the occurrence of undesired flashbacks on or near the base plate.

Further, it is noted that when a lip such as lip 36 is not present on a base plate, a downstream end, such as the downstream end 19 of the main swirler assembly 18 of FIGS. 1A and 1B, may project outwardly from the base plate's aperture for it, and may receive the benefits of laterally directed apertures described herein.

Figure 2:
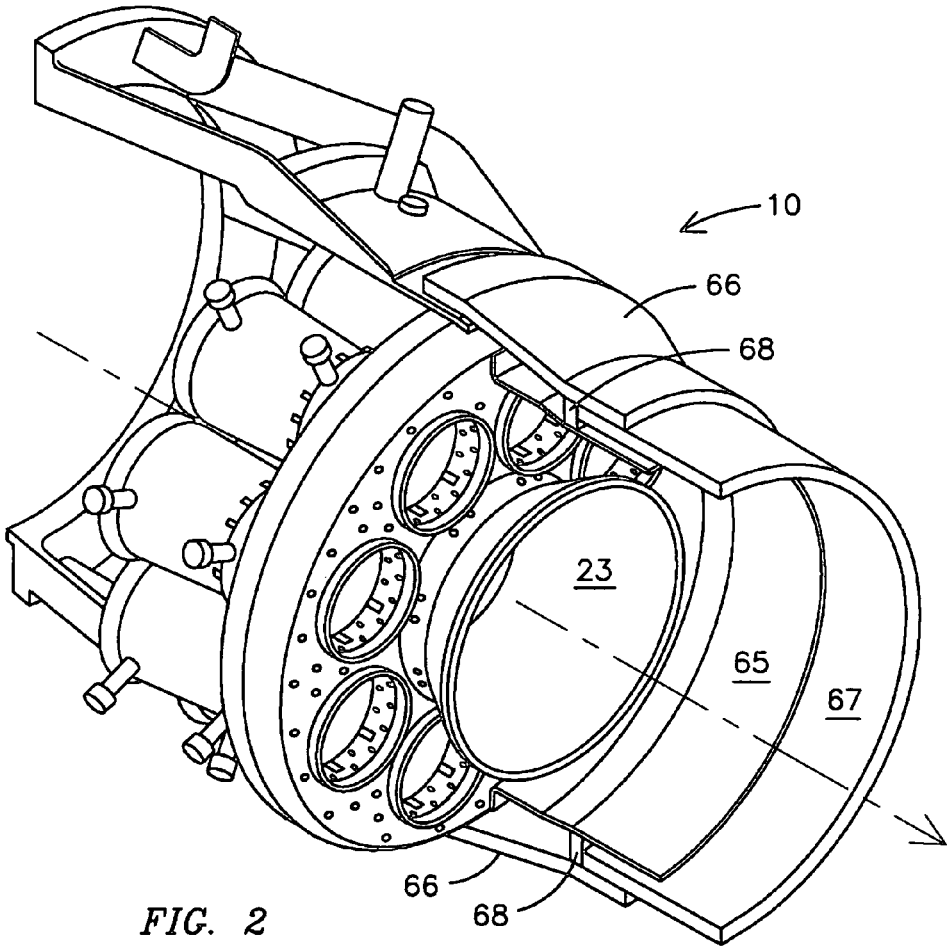
FIG. 2 provides a schematic side view of a portion of a combustor 200 that has an alternative design compared to the embodiment of FIGS. 1A-1C.

FIG. 2 provides a schematic side view of a portion of a combustor 200 that has an alternative design compared to the embodiment of FIGS. 1A-1C, which alternative design nonetheless also utilizes laterally directed apertures to achieve the results described herein. In FIG. 2 an extended inner connector ring 65 is provided instead of the combustor shroud 50 in FIGS. 1A-C. An outer connector ring 66 is positioned more radially outward from the centerline of the combustor 200 relative to the inner connector ring 65, and connects the most downstream edge of the combustor basket 30 with an upstream edge of a combustor basket liner 67. A spacer ring 68 helps join the inner connector ring 65, the outer connector ring 66, and the combustor liner basket.

In such alternative design, the laterally directed apertures 60 function as described above in the discussion of FIGS. 1A-C.

Figure 3:
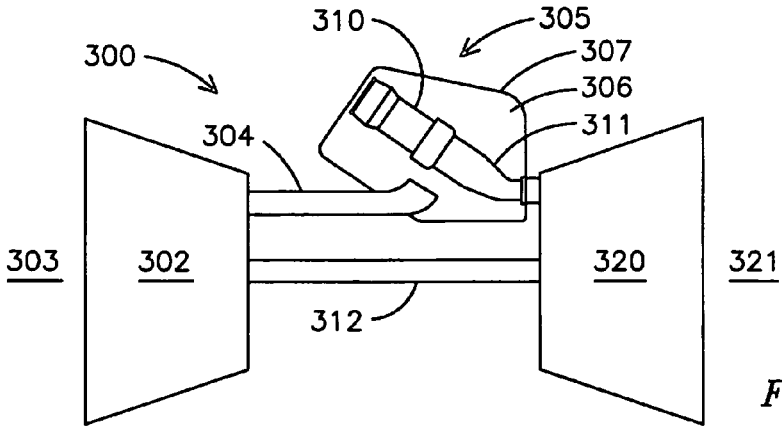
FIG. 3 is a schematic lateral cross-sectional depiction of a gas turbine showing major components, in which embodiments of the present invention may be utilized.

Embodiments of the present invention are used in gas turbine engines such as are represented by FIG. 3, which is a schematic lateral cross-sectional depiction of a prior art gas turbine 300 showing major components. Gas turbine engine 300 comprises a compressor 302 at a leading edge 303, a turbine 320 at a trailing edge 321 connected by shaft 312 to compressor 302, and a mid-frame section 305 disposed there between. The mid-frame section 305, defined in part by a casing 307 that encloses a plenum 306, comprises within the plenum 306 a combustor 310 (such as a can-annular combustor) and a transition 311. During operation, in axial flow series, compressor 302 takes in air and provides compressed air to an annular diffuser 304, which passes the compressed air to the plenum 306 through which the compressed air passes to the combustor 310, which mixes the compressed air with fuel (not shown), providing combusted gases via the transition 311 to the turbine 320, whose rotation may be used to generate electricity. It is appreciated that the plenum 306 is an annular chamber that may hold a plurality of circumferentially spaced apart combustors 310, each associated with a downstream transition 311. Likewise the annular diffuser 304, which connects to but is not part of the mid-frame section 305, extends annularly about the shaft 312. Embodiments of the present invention may be incorporated into each combustor (such as 310) of a gas turbine engine to reduce or eliminate flashback.

It should be understood that the examples and embodiments described herein are for illustrative purposes only and that various modifications or changes in light thereof will be suggested to persons skilled in the art and are to be included within the spirit and purview of this application and the scope of the appended claims.

The invention claimed is:

1. A gas turbine combustor comprising:

a. a base plate having a body extending perpendicularly to a longitudinal flow-axis of the combustor to define a partial flow barrier and comprising at least one aperture for a main swirler assembly, a centrally disposed aperture for a pilot burner, and a plurality of axially-directed apertures for passage of fluid from an upstream side to a downstream side of the base plate;

b. the main swirler assembly having an upstream end and a downstream end, the downstream end disposed in the at least one aperture;

c. a structure adjacent the pilot burner aperture comprising a plurality of laterally-directed apertures effective to reduce the occurrence of undesired flashbacks on or near the base plate; and d. the base plate comprising a lip formed about the main swirler assembly aperture, the lip extending to the downstream side from the base plate body.

2. A gas turbine combustor comprising:

a base plate having a body extending perpendicularly to a longitudinal flow-axis of the combustor to define a partial flow barrier and comprising at least one aperture for a main swirler assembly, a centrally disposed aperture for a pilot burner, and a plurality of axially-directed apertures for passage of fluid from an upstream side to a downstream side of the base plate;

the main swirler assembly having an upstream end and a downstream end, the downstream end disposed in the at least one aperture;

a structure adjacent the pilot burner aperture comprising a plurality of laterally-directed apertures effective to reduce the occurrence of undesired flashbacks on or near the base plate; and wherein the structure adjacent the pilot burner aperture is a pilot cone comprising an inner cone and an outer cone providing a channel for fluid there between, the outer cone comprising the laterally-directed apertures.

3. The combustor of claim 2, the laterally-directed apertures positioned along a base region of the outer cone adjacent the base plate.

4. The combustor of claim 1, the laterally-directed apertures positioned along a base region of the outer cone adjacent the base plate and closer to a near portion of the lip than to a side portion of the lip.

5. A gas turbine engine comprising the combustor of claim 1.

6. A gas turbine engine comprising the combustor of claim 4.

* * * * *